United States Patent [19]

Hale

[11] 4,244,069

[45] Jan. 13, 1981

[54] METHOD AND APPARATUS FOR BINDING SHEETS

[75] Inventor: James M. Hale, Chicago, Ill.

[73] Assignee: Xerox Corporation, Stamford, Conn.

[21] Appl. No.: 42,738

[22] Filed: May 29, 1979

[51] Int. Cl.[3] ..... B42C 9/00

[52] U.S. Cl. ..... 11/1 AD; 156/84; 156/477 B; 206/450; 281/29

[58] Field of Search ..... 11/1 AD, 2; 156/84, 156/477 B; 206/450; 281/1, 29; 428/200, 347, 349, 913

[56] References Cited

U.S. PATENT DOCUMENTS 3,437,506 4/1969 Falberg ..... 428/347 X

FOREIGN PATENT DOCUMENTS 2425284 12/1974 Fed. Rep. of Germany ..... 428/349

6711263 2/1969 Netherlands ..... 11/1 AD

OTHER PUBLICATIONS

Book Binding Made Easy–L. M. Klinefelter, Bruce Publ., Milwaukee, WI, ©1960.

*Primary Examiner*—Paul A. Bell

[57] ABSTRACT

A method and material for binding sheets, the material being formed of a heat shrinkable plastic having a strip of hot melt adhesive down the center thereof, placement of a stack of sheets to be bound within a cover having at least the backbone or spine portion thereof formed of the heat shrinkable plastic, with the edges of the sheets to be bound in contact with the hot melt adhesive and subsequent heating of the backbone causing the adhesive to melt and the backbone material to shrink into tight engagement with the sheets being bound.

3 Claims, 5 Drawing Figures

METHOD AND APPARATUS FOR BINDING SHEETS

BACKGROUND OF THE INVENTION

A number of machines are now commercially available for use in an office environment to enable simple production of bound booklets. The devices disclosed in U.S. Pat. No. 3,928,119 issued Dec. 23, 1975 to Ernest J. Sarring and assigned to Xerox Corporation and U.S. Pat. No. 3,616,074 issued Oct. 26, 1971, both illustrate suitable mechanisms for producing bound booklets. However it can be seen by reference to both of the aforementioned patents that a fairly complex machine is provided with means for tightly clamping the sheets to be bound between the covers to be attached thereto. Further, means are provided to hold the backbone material of the cover firmly against the sheet edges to be bound while applying heat to melt a hot melt adhesive and assure that the adhesive is driven into the edges of the sheets to be bound. The pressures involved in holding the covers against the sheets and the backbone material against the edge of the sheets are substantial and numerous cams, gears, rollers, etc. are required to accomplish the binding process.

It is therefore the object of this invention to provide a simple yet effective book binding material and method for utilizing the material which does not require the extensive mechanisms disclosed in the aforementioned patents.

SUMMARY OF THE INVENTION

A sheet binding material and method for forming a bound booklet wherein a cover is provided having a backbone or spine formed of a heat shrinkable material having a strip of hot melt adhesive on the center thereof for contact with sheets to be bound. Sheets are inserted into the cover and the cover backbone is heated to shrink the backbone and melt the adhesive. Shrinking of the backbone produces a clamping pressure on the booklet. At the same time, the adhesive melts and is forced into the edges of the sheets by the pressure exerted by the shrinking backbone to provide a tightly bound booklet.

DESCRIPTION OF THE PREFERRED EMBODIMENT

Figure 1:
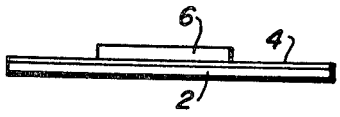
FIG. 1 illustrates a sheet binding material strip having hot melt adhesive in the center with pressure sensitive adhesive on either side thereof for forming a booklet cover in conjunction with suitable top and bottom cover leaves.

Referring to FIG. 1 there is illustrated the preferred binding material of the subject invention. The binding material is in the form of a plastic strip 2 which could be of indeterminate length and provided on a roll in a suitable dispenser somewhat akin to a tape dispenser. The backbone or binding strip is formed of a suitable material which will shrink when subjected to heat. Suitable materials for this purpose are PVC and PVF vinyls, oriented unbalanced polyethelene, polyolefin and polypropylene, and PET polyesters.

Figure 2:
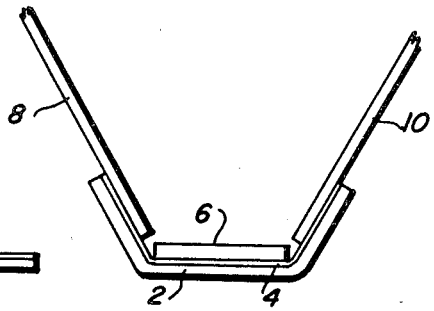
FIG. 2 illustrates a preformed booklet cover having the backbone material of FIG. 1 preassembled to top and bottom cover leaves.

As illustrated in FIGS. 1, 2, 4 and 5, a pressure sensitive adhesive layer 4 is provided on the binding strip along with a center strip or section 6 of a hot melt binding adhesive. Top and bottom cover leaves 8 and 10 may be provided already affixed to the binding strip or as illustrated in FIG. 2 or the strip may be provided without the cover material as in FIG. 1 to allow the end users to affix their own cover stock to the strip by pressing the desired cover material onto the pressure sensitive adhesive.

Figure 5:
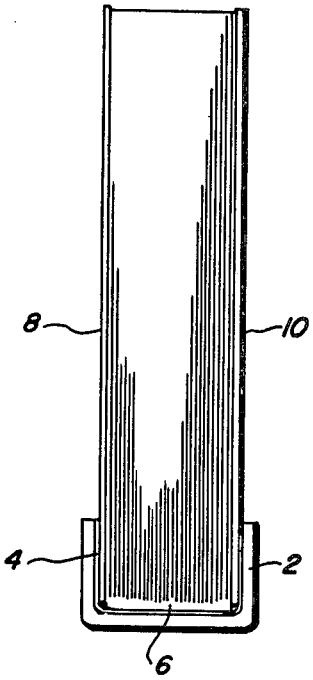

In the booklet illustrated in FIG. 5, the spine or backbone material 2 was formed from an irradiated polyvinyl chloride, 0.030 thick (recovered), thermally reactive from 325° to 375° F. exhibiting 50% transverse shrinkage with less than 5% longitudinal shrink. The cover stock, (a card stock weight paper) and hot melt, ethyl vinyl acetate (pre extruded) were affixed to the spine material using an acrylate base pressure sensitive adhesive. If desired, the entire cover and backbone can be formed in one piece as illustrated in FIG. 3 with the spine or backbone section of the material being prestretched to provide a one piece cover.

Figure 3:
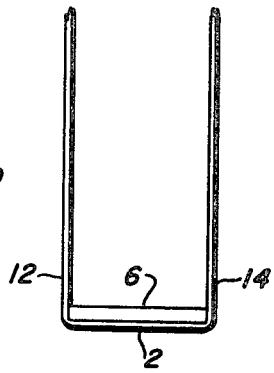
FIG. 3 illustrates a booklet cover wherein the top and bottom leaves are formed of the same material as the backbone.

To utilize this material, the sheets to be bound are placed in a cover formed either from one piece of plastic having top and bottom leaves 12 and 14 as illustrated in FIG. 3 or a cover is assembled by utilizing suitable cover or card stock attached to the pressure sensitive strips as illustrated in FIG. 2. Once the sheets are hand aligned in the cover in the desired position, the cover can be held against the sheets either by hand pressure or a suitable simple clamp (not shown) while the backbone of the booklet is heated. Heating of the backbone may be accomplished by radiant heat such as a heat lamp, heat from a ribbon type heating element, microwaves, etc., or by direct contact between the backbone and a heated surface such as a hot platen. The platen preferably would be a simple, flat, hot plate adapted to be heated to the desired temperature range to cause the backbone material to shrink and melt the hot melt adhesive thereon. Due to the tendency of the disclosed materials to vigorously try to return to their original "unstretched" state, a substantial clamping pressure is provided by the backbone material itself which holds the sheets to be bound tightly together and also causes the hot melt glue to be forced into the edges of the sheets.

Not only does this material and method allow an inexpensive, simple, and rapid method for binding booklets, but due to the nature of the backbone material, a single width binding strip will accept a variety of book thicknesses since the strip actually shrinks, within limits, to fit the number of sheets enclosed between the covers.

Figure 4:
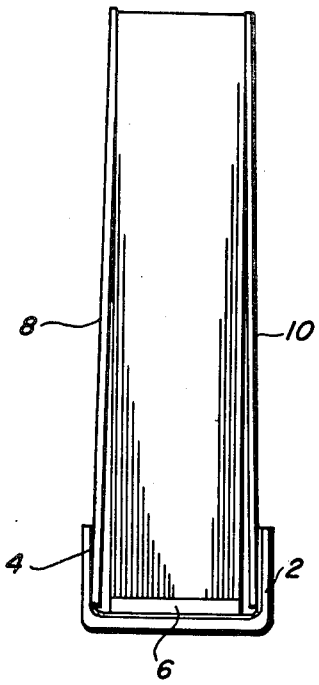
FIG. 4 illustrates the cover of FIG. 2 having sheets therein prior to binding and FIG. 5 illustrates the bound booklet formed by the application of heat to the materials illustrated in FIG. 4.

FIG. 4 illustrates the unshrunk binding before application of heat while FIG. 5 illustrates the finished, tightly bound booklet that results from the application of heat to the backbone material. It can be seen from the forgoing that a simple yet highly effective binding method and material are provided which allow the production of high quality booklets with a minimum of equipment or investment. Further, the method is so simple that virtually no training is required, a simple demonstration of the process is sufficient.

While I have disclosed the preferred embodiments of my invention it is to be understood that the invention is not limited thereto but may be otherwise embodied within the scope of the following claims.

What is claimed is:

1. A sheet binding material for forming a book cover including a cover backbone formed of a heat shrinkable material, the center portion of the material being prestretched, a strip of hot melt adhesive on said center portion of the cover backbone for contact with sheets to be bound; and, pressure sensitive adhesive strips on said cover backbone parallel to and on both sides of said hot melt adhesive strip to enable a top and a bottom cover leaf to be attached to said cover backbone by pressing said leaves against said pressure sensitive adhesive strips to form a book cover for insertion of sheets to be bound therein, heating of said cover backbone causing said adhesive to melt into the edges of inserted sheets to glue the sheets into the cover, the heat also causing said prestretched center portion to shrink against the inserted sheets to form a tightly bound booklet.

2. A sheet binding material for forming a book cover including a cover backbone formed of a heat shrinkable material having a prestretched center portion thereof, a strip of hot melt adhesive on said center prestretched portion of the cover backbone for contact with sheets to be bound; and, a top leaf and a bottom leaf attached to said backbone to form a book cover for insertion of sheets to be bound therein, heating of said cover backbone causing said adhesive to melt into the edges of inserted sheets to glue the sheets into the cover, the heat also causing said prestretched center portion to shrink against the inserted sheets to form a tightly bound booklet.

3. A sheet binding material according to claim 2 wherein said top and bottom leaves are formed coextensive with said backbone, the material being prestretched only in the backbone area to provide a shrinkable binding.

* * * * *